US008622583B1

(12) United States Patent
Liu et al.

(10) Patent No.: US 8,622,583 B1
(45) Date of Patent: Jan. 7, 2014

(54) LED LAMP SCATTERING HEAT SWIFTLY BY EXCHANGING CURRENTS

(75) Inventors: Chung-Chi Liu, Shenzhen (CN); Hua-Zheng Li, Shenzhen (CN)

(73) Assignees: Shenzhen Jiawei Photovoltaic Lighting Co., Ltd., Shenzhen (CN); Light-Core Limited, Shenzhen (CN)

( * ) Notice: Subject to any disclaimer, the term of this patent is extended or adjusted under 35 U.S.C. 154(b) by 0 days.

(21) Appl. No.: 13/609,735

(22) Filed: Sep. 11, 2012

(51) Int. Cl.
*F21V 29/02* (2006.01)

(52) U.S. Cl.
USPC ..... 362/294; 362/311.02

(58) Field of Classification Search
USPC ..... 362/249.02, 294, 311.02
See application file for complete search history.

(56) References Cited

U.S. PATENT DOCUMENTS

2010/0165632 A1* 7/2010 Liang ..... 362/294
2013/0128589 A1* 5/2013 Kim et al. ..... 362/294

* cited by examiner

*Primary Examiner* — David V Bruce
(74) *Attorney, Agent, or Firm* — Rosenberg, Klein & Lee

(57) ABSTRACT

An LED lamp scattering heat swiftly by exchanging currents mainly constructs multiple channels interleaved in heat scattering areas among fin units of a cooling device. At least one first hole is defined on a wall of each channel for assisting the channels in communicating with the heat scattering areas. Accordingly, the exterior air is introduced from the channels into an accommodating chamber of a seat body of the LED lamp. Thence, a fan installed in the LED lamp further blows the exterior air and the wasted heat of the LED unit to cause a current exchanging effect. Whereby, the wasted heat is efficiently expelled from the LED lamp, which increases the heat radiating efficiency and the using life of the LED lamp and remedies restrictions on installations of the LED lamp for expanding the lamp application.

4 Claims, 7 Drawing Sheets

LED LAMP SCATTERING HEAT SWIFTLY BY EXCHANGING CURRENTS

BACKGROUND OF THE INVENTION

1. Field of the Invention

The present invention relates to a design of an LED lamp, particularly to an LED lamp preferably scattering heat swiftly by exchanging currents.

2. Description of the Related Art

Referring to FIG. 1, a conventional LED lamp 1 comprises a seat body 11 including an accommodating chamber 111, a protective cover 10 connected to a rim of the seat body 11, a light module 12 installed within the accommodating chamber 111, and a cooling device 13. Wherein, the light module 12 has an electrically-connected circuit board 121, an optical reflector 122 disposed on the circuit board 121, and at least one LED unit 123 disposed on the circuit board 121. Moreover, the cooling device 13 has a fin set 131 disposed around the optical reflector 122, and a fan 132 disposed under the circuit board 121. In using, the LED unit 123 and the circuit board 121 are electrified for emitting light through the optical reflector 122, and heat generated by the LED unit 123 is released via the cooperation of the fan 132 and the fin set 131.

In practice, referring to FIG. 2, the heat in the LED lamp 1 generated during lighting may be released via the fan 132 and the fin set 131. However, the effect of heat dispersion depends on materials adopted on the fin set 131. Namely, if the fin set 131 is made of materials that possess the higher radiating coefficient, the effect of heat dispersion in the LED lamp 1 favorably advances. Oppositely, if the fin set 131 is made of materials that possess the lower radiating coefficient, the heat in the LED lamp 1 can not be timely released, which adversely incurs an overheated LED lamp 1. As a result, either the lighting effect or the using life of the LED lamp 1 is influenced.

In fact, where the LED lamp 1 is placed is also one of the factors that influence the effect of heat dispersion. Namely, if the seat body 11 of the LED lamp 1 is uncovered and attached to ceilings, plywood, or any other decorative rails, a favorable effect of heat dispersion could be provided. Oppositely, as shown in FIG. 2, the seat body 11 of the LED lamp 1 may be also embedded in a ground G. A large quantity of wasted heat is similarly generated after the LED unit 123 and the optical reflector 122 continuingly provide light. Herein, since the seat body 11 of the LED lamp 1 is wrapped in the compact ground material G, and the protective cover 10 is designed solid, there is only the narrow and small accommodating chamber 111 left between the fin set 131 and the seat body 11 for wasted heat to be removed out (as shown by dotted-line arrows in FIG. 2). Herein, cooling air out of the LED lamp 1 can not get into the seat body 11. Thus, the wasted heat generated in time of lighting is difficultly to be dispersed out of the accommodating chamber 111 of the LED lamp 1. Obviously, the LED lamp 1 is thence overheated. Therefore, the lighting effect and the using life of the LED lamp 1 are both affected.

SUMMARY OF THE INVENTION

It is therefore the purpose of this invention to provide an LED lamp scattering heat swiftly by exchanging currents. Namely, when the currents are exchanged by means of a fin set providing a plurality of channels for communicating with an accommodating chamber in the LED lamp, circulation of air is constructed for promoting the heat dispersion of the LED lamp and expanding the application of the LED lamp.

The LED lamp scattering heat swiftly by exchanging currents in accordance with the present invention comprises a seat body including an accommodating chamber, a light module installed within the accommodating chamber, and a cooling device correspondingly disposed to the light module. Wherein, the light module has an electrically-connected circuit board, an optical reflector disposed on the circuit board, and at least one LED unit disposed on the circuit board. The cooling device has a fan installed under the circuit board, and a fin set enveloping the circuit board and the optical reflector. A room is formed within the fin set for holding the circuit board and the optical reflector. A plurality of fin units are extended outward from the fin set. Wherein, the fin set comprises a plurality of heat scattering areas defined among the fin units at intervals and a plurality of channels disposed between the heat scattering areas. Each of the heat scattering areas is communicated with the accommodating chamber and disposed corresponding to the fan. A side of each channel toward the seat body is formed into a closed stated. At least one first hole is defined on a periphery wall of each channel and disposed corresponding to the adjacent fin unit for assisting the channels in communicating with the heat scattering areas, thereby introducing exterior air into the seat body through the channels and allowing the fan to guide the exterior air into the heat scattering areas for resulting in a current exchanging effect between the exterior air and wasted heat from the LED lamp.

Preferably, a protective cover with a plurality of openings defined thereon is connected to a rim of the seat body.

Preferably, the cooling device further includes a lodging set connecting to the fin set, and the lodging set has a plurality of lodging units disposed at intervals for corresponding to part of the fin units so that each of the channels is enclosed by combining each lodging unit with each corresponding fin unit and each of the heat scatting areas is formed between a remainder of the fin units which do not cooperate with the lodging units.

Accordingly, exterior air is introduced into the seat body through the channels. Thence, the fan guides the exterior air traveling around the heat scattering area for forming current circulation in the accommodating chamber to effectively cool the heat generated from the light module in the eat body of the LED lamp. As a result, currents of the wasted heat and the exterior air are circularly exchanged in the LED lamp and expelled therefrom. Thereby, the heat can be favorably scattered, so the using life of the LED lamp is prolonged. Moreover, installing location of the LED lamp is unlimited since the wasted heat can be scattered efficiently. Accordingly, the LED lamp can be more expansively installed and used.

DETAILED DESCRIPTION OF THE PREFERRED EMBODIMENTS

Figure 1:
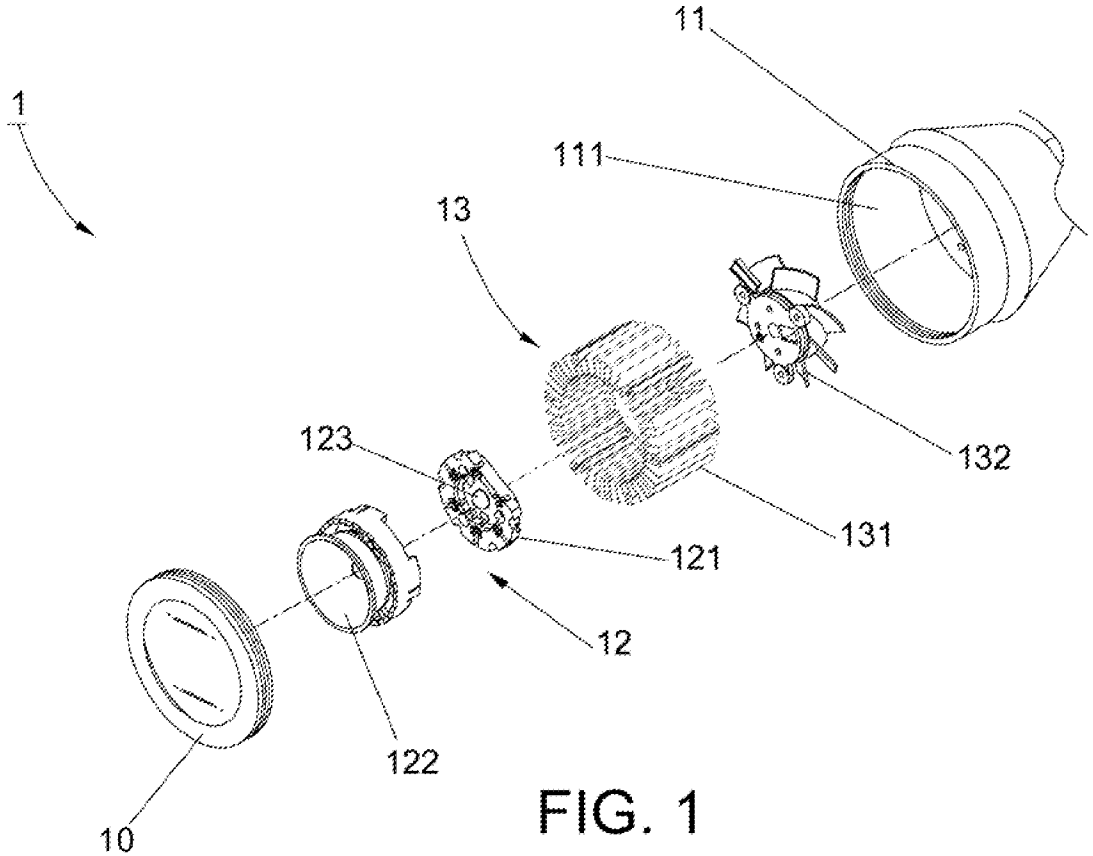
FIG. 1 (PRIOR ART)
FIG. 1 is a schematic view showing a conventional LED lamp.
Figure 2:
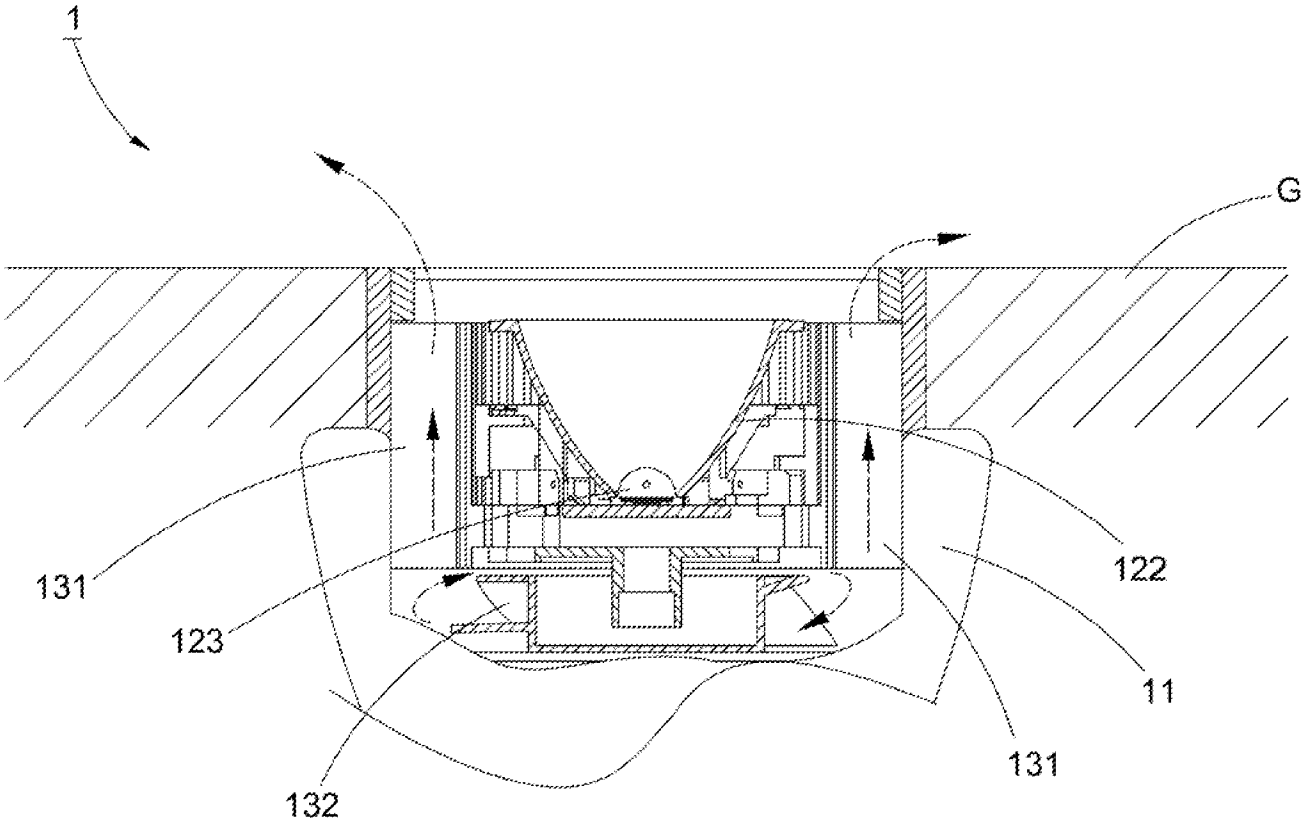
FIG. 2 (PRIOR ART)
FIG. 2 is a cross-sectional view of the conventional LED lamp.

Wherever possible, the same reference numbers are used in the drawings and the description to refer to the same or like parts.

Figure 3:
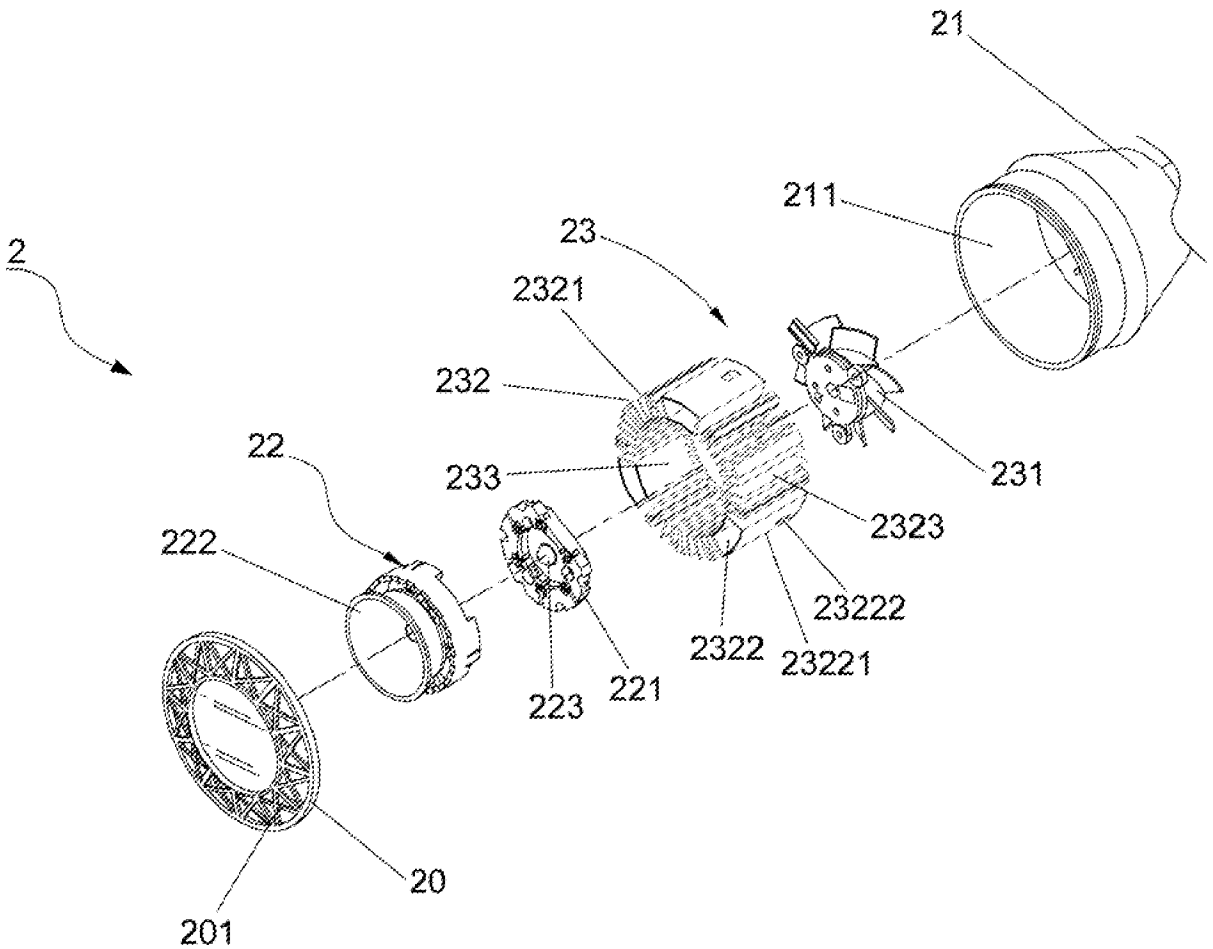
FIG. 3 is a schematic view showing a first preferred embodiment of the present invention.

Referring to FIG. 3, a first preferred embodiment of the present invention is shown. An LED lamp 2 scattering heat swiftly by exchanging currents comprises a seat body 21 including an accommodating chamber 211, a light module 22 installed within the accommodating chamber 211, and a cooling device 23 correspondingly disposed to the light module 22. Further, the light module 22 has an electrically-connected circuit board 221, an optical reflector 222 disposed on the circuit board 221, and at least one LED unit 223 disposed on the circuit board 221. Herein, the LED unit 223 provides light and emits light out of the LED lamp 2 through the optical reflector 222.

Moreover, the cooling device 23 has a fan 231 installed under the circuit board 221, and a fin set 232 disposed between the circuit board 221 and the fan 231 for enveloping the optical reflector 222. There is a room 233 formed in the fin set 232 for receiving the circuit board 221 and the optical reflector 222. Especially, the fin set 232 comprises a plurality of heat scattering areas 2323 defined among the fin units 2321 at intervals and a plurality of channels 2322 disposed between the heat scattering areas 2323. Each of the heat scattering areas 232 is communicated with the accommodating chamber 211 and disposed corresponding to the fan 231. A side of each channel 2322 toward the seat body 21 is formed into a closed stated. At least one first hole 23222 defined on a periphery wall 23221 of each channel 2322 and disposed corresponding to the adjacent fin unit 2321. The first hole 23222 assists the channels 2322 in communicating with the heat scattering areas 2323, corresponding to the fan 231. Thereby introducing exterior air into the seat body 21 through the channels 2322 and allowing the fan 231 to guide the exterior air into the heat scattering areas 2323 for resulting in a current exchanging effect between the exterior air and wasted heat of the LED unit 223 within accommodating chamber 211 of the seat body 21 of the LED lamp 2.

Additionally, a protective cover 20 connected to a rim of the seat body 21 can be freely adopted in this embodiment for preferably preventing objects from intruding into the seat body 21, and the protective cover 20 also defines a plurality of openings 201 that further communicate with both the channels 2322 and the heat scattering areas 2323. Herein, the protective cover 20 is adopted depending on practical situation.

Figure 4:
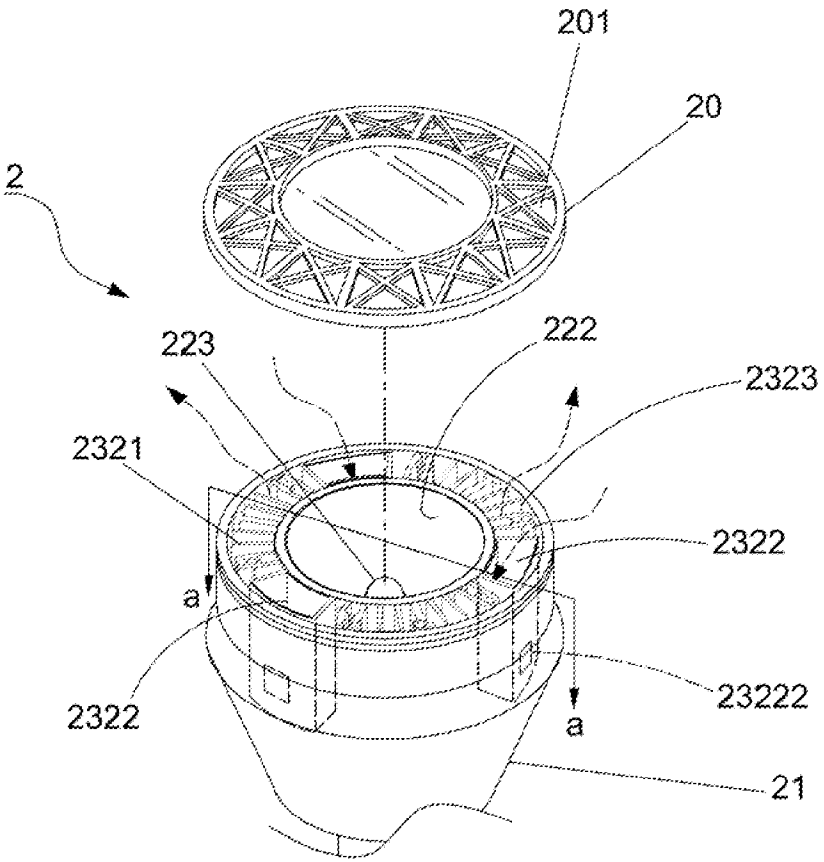
FIG. 4 is a schematic view of the first preferred embodiment of the present invention in operation.
Figure 5:
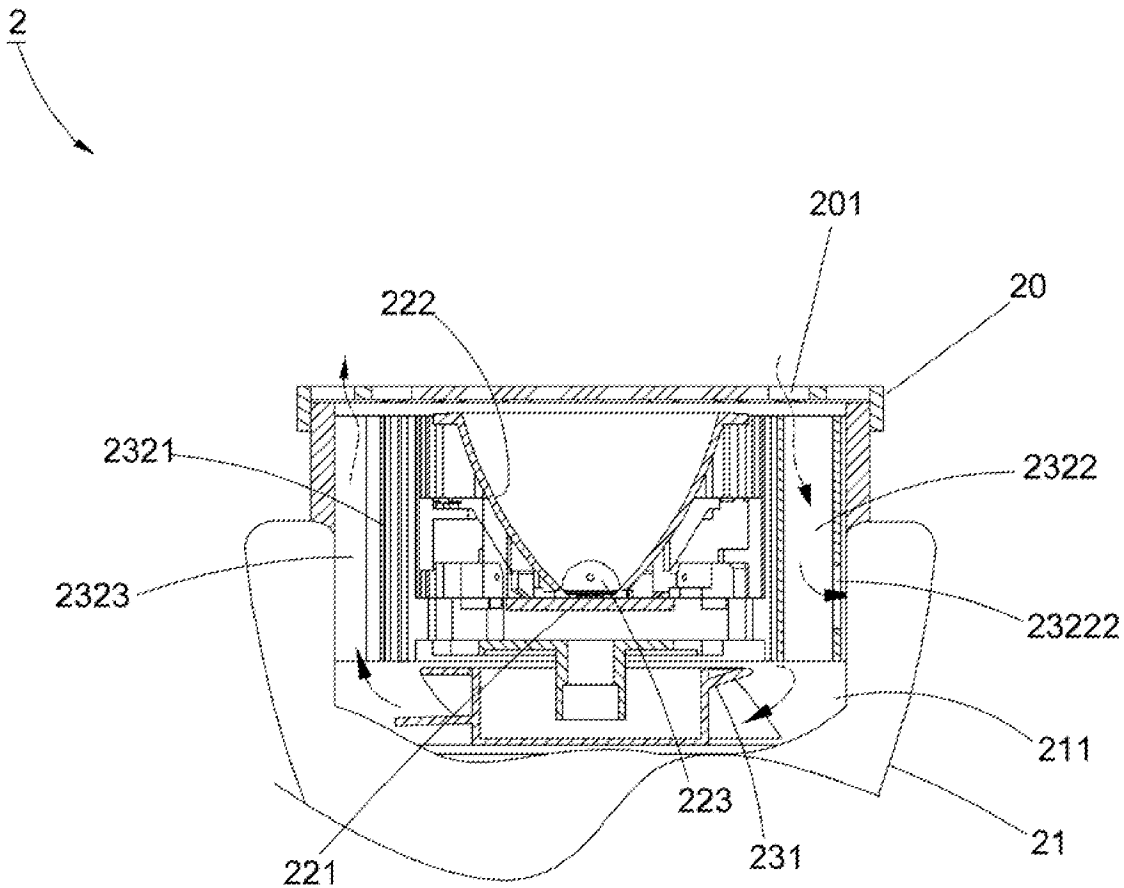
FIG. 5 is a cross-sectional view of part a-a in FIG. 4.

Referring to FIGS. 3 to 5, in using, the LED unit 223 and the circuit board 221 are electrified to emit light. Namely, the light goes through the optical reflector 222 and then illuminates any desired places. Concurrently, the fan 231 under the circuit board 221 is driven during the illumination. When the LED unit 223 keeps lighting and creating heat energy, the seat body 21 is full of wasted heat. Herein, one side of the channel 2322 near the seat body 21 is formed closed. Accordingly, when the exterior air enters the LED lamp 2, the exterior air firstly goes through the first hole 23222 on each channel 2322 and then travels in the accommodating chamber 211 of the seat body 21. In the meantime, the fin units 2321 are cooled by the exterior air, and the fan 231 guides the wasted heat around the heat scattering areas 2323 out of the protective cover 20, so that current circulation by exchanging the currents of the wasted heat and the exterior air is executed in the seat body 21. Preferably, the wasted heat is efficiently expelled, which concurrently enhances the heat dispersing effect of the LED lamp 2 and prolongs the using life of the same.

Whereby, no matter the LED lamp 2 is placed in an exposed manner or a hidden manner, the channels 2322 guides the exterior air to go around the heat scattering area 2323 of the fin set 232 via the first hole 23222 so as to cool accordingly. Concurrently, the fan 231 pushes and blows the exterior air that is mixed with the wasted heat for introducing the circulation of currents to enhance the heat dispersing effect. As a result, when the wasted heat is guided out of the openings 201 of the protective cover 20, the LED lamp 2 can be cooled easily. Therefore, the using life of the LED lamp 2 can be prolonged and the installing location of the LED lamp 2 becomes free and more expansive now since the heat dispersing problem is resolved.

Figure 6:
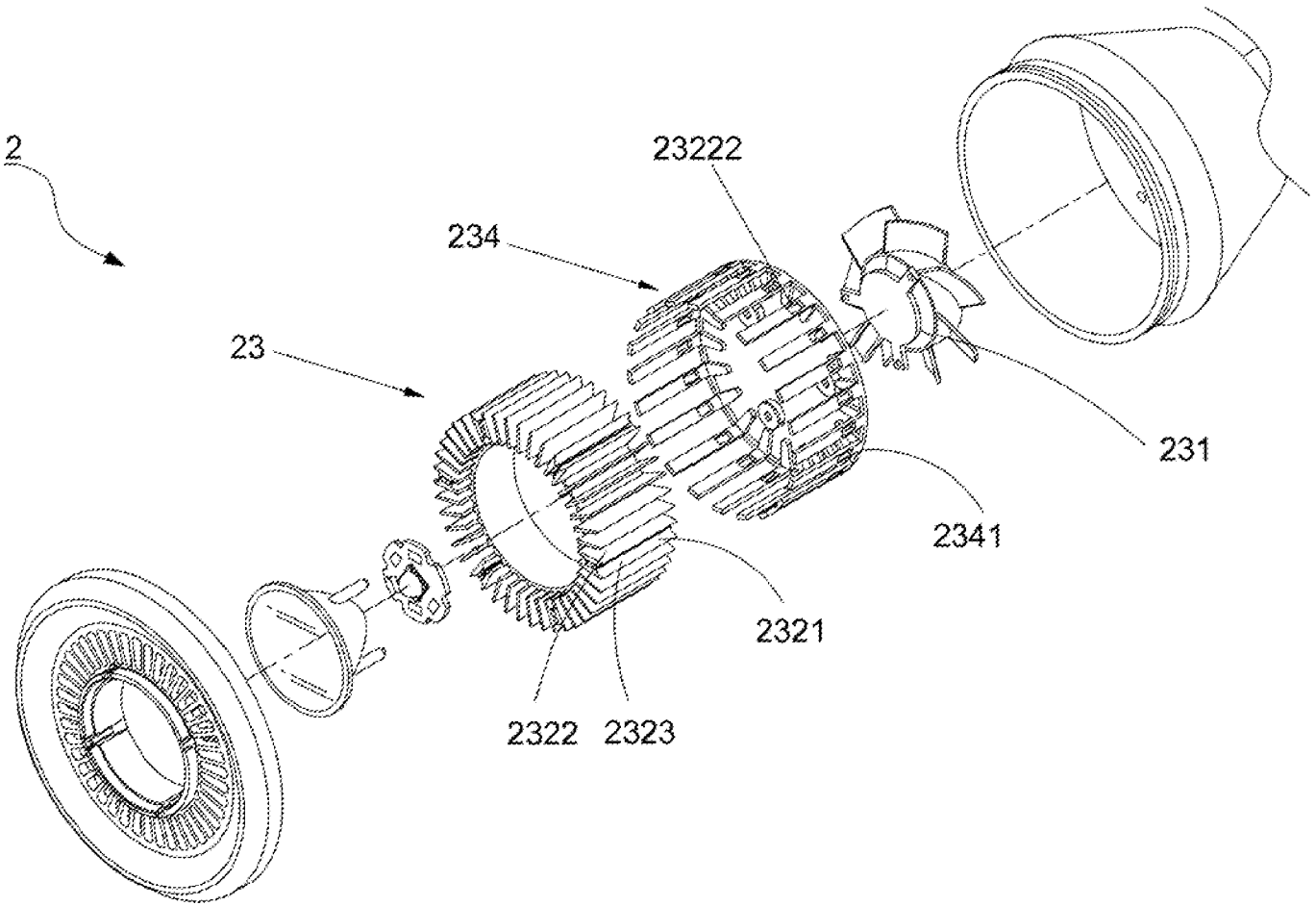
FIG. 6 is a schematic view showing a second preferred embodiment of the present invention.
Figure 7:
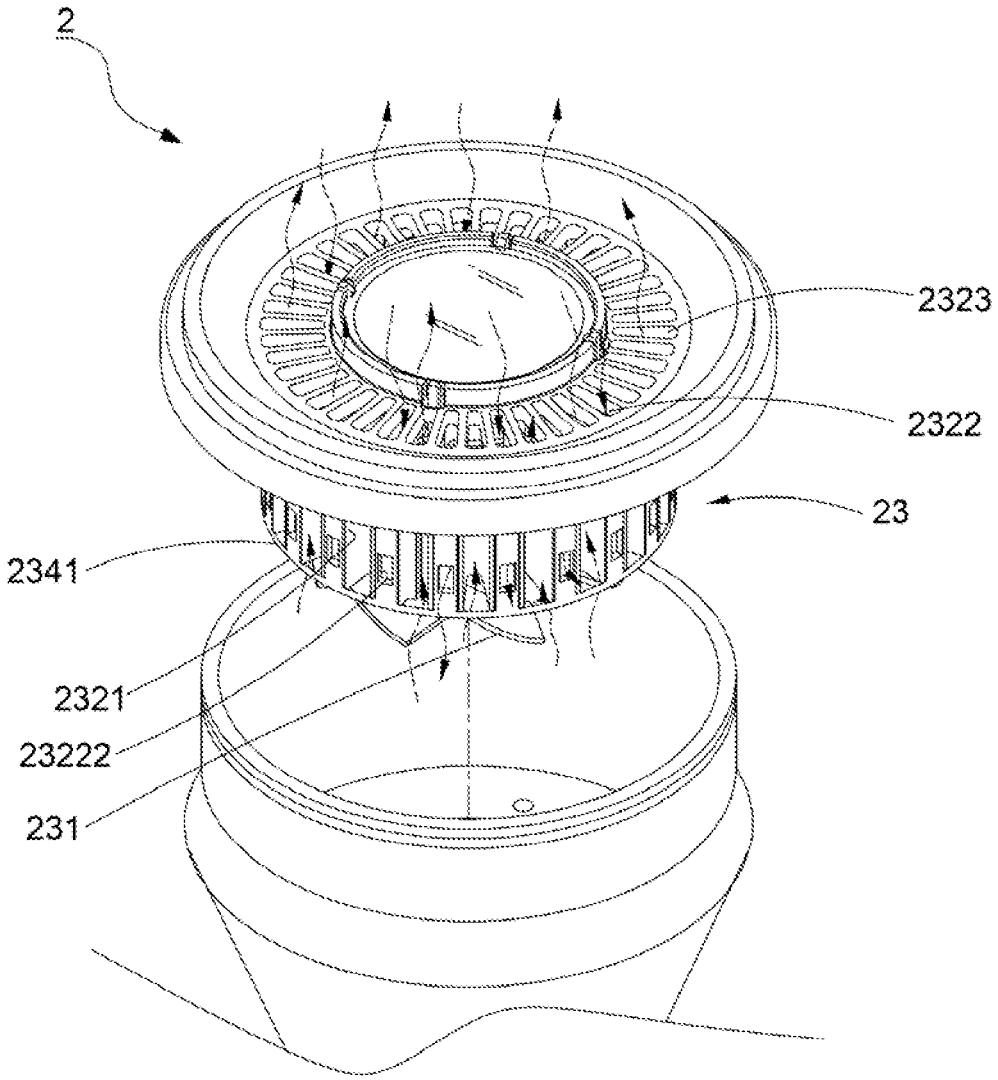
FIG. 7 is a schematic view of partial elements in the second preferred embodiment of the present invention.

Referring to FIGS. 6 and 7, a second preferred embodiment of the present invention is shown. In order to clearly show features of the present invention in this embodiment, the LED lamp 2 is basically shown by a structure derived from the first preferred embodiment. Differently, the cooling device 23 further includes a lodging set 234 connecting to the fin set 232, and the lodging set 234 has a plurality of lodging units 2341 disposed at intervals for corresponding to part of the fin units 2321 so that each of the channels 2322 is enclosed by combining each lodging unit 2341 with each corresponding fin unit 2321 and each of the heat scatting areas 2323 is formed between a remainder of the fin units 2321 which do not cooperate with the lodging units 2341. Accordingly, the channels 2322 is used to guide exterior air into the LED lamp 2 for attaining the effect of current circulation around the heat scattering areas 2323 and the fin units 2321. When the fan 231 is driven, the wasted heat and the exterior air are exchanged and the exchanged current is expelled from the heat scattering areas 2323 efficiently. Preferably, the using life of the present invention is enhanced, and the installing location of the LED lamp 2 is unlimited, which expands the application of the LED lamp 2.

To sum up, the present invention particularly constructs multiple heat scattering areas among the fin units of the cooling device at intervals and channels disposed between the fin units. When the heat scattering areas are communicated with the accommodating chambers via the first holes, the channels introduce the exterior air to go around the heat scattering areas via the first holes, and the fan brings the exterior air and the wasted heat in the seat body to exchange for causing circulation of currents. Thereby, the heat scattering areas thence disperse heat in the seat body. Preferably, a favorable radiating effect of the present invention is easily achieved and enhanced. Additionally, the using life of the LED lamp is further extended. Further, when the installing location of the LED lamp is unlimited, the LED lamp of the present invention can be more expansively applied.

While we have shown and described the embodiment in accordance with the present invention, it should be clear to those skilled in the art that further embodiments may be made without departing from the scope of the present invention.

We claim:

1. An LED lamp scattering heat swiftly by exchanging currents comprising a seat body including an accommodating chamber, a light module installed within said accommodating chamber, and a cooling device correspondingly disposed to said light module; wherein, said light module has an electrically-connected circuit board, an optical reflector disposed on said circuit board, and at least one LED unit disposed on said circuit board; said cooling device having a fan installed under said circuit board, and a fin set enveloping said circuit board and said optical reflector; a room being formed within said fin set for holding said circuit board and said optical reflector; a plurality of fin units being extended outward from said fin set;

wherein, said fin set comprises a plurality of heat scattering areas defined among said fin units at intervals and a plurality of channels disposed between said heat scattering areas; each of said heat scattering areas being communicated with said accommodating chamber and disposed corresponding to said fan; a side of each channel toward said seat body being formed into a closed stated; at least one first hole being defined on a periphery wall of each channel and disposed corresponding to said adjacent fin unit for assisting said channels in communicating with said heat scattering areas, thereby introducing exterior air into said seat body through said channels and allowing said fan to guide said exterior air into said heat scattering areas for resulting in a current exchanging effect between said exterior air and wasted heat from said LED lamp.

2. The LED lamp as claimed in claim 1, wherein, a protective cover with a plurality of openings defined thereon is connected to a rim of said seat body.

3. The LED lamp as claimed in claim 1, wherein, said cooling device further includes a lodging set connecting to said fin set, and said lodging set has a plurality of lodging units disposed at intervals for corresponding to part of said fin units so that each of said channels is enclosed by combining each lodging unit with each corresponding fin unit and each of said heat scatting areas is formed between a remainder of said fin units which do not cooperate with said lodging units.

4. The LED lamp as claimed in claim 2, wherein, said cooling device further includes a lodging set connecting to said fin set, and said lodging set has a plurality of lodging units disposed at intervals for corresponding to part of said fin units so that each of said channels is enclosed by combining each lodging unit with each corresponding fin unit and each of said heat scatting areas is formed between a remainder of said fin units which do not cooperate with said lodging units.

* * * * *